United States Patent [19]

Pelsue et al.

[11] 4,108,143

[45] Aug. 22, 1978

[54] FORCED AIR HEATER BLOWER

[75] Inventors: Bradley A. Pelsue, Lakewood; Allan E. Beavers, Littleton, both of Colo.

[73] Assignee: T.A. Pelsue Company, Englewood, Colo.

[21] Appl. No.: 789,104

[22] Filed: Apr. 20, 1977

[51] Int. Cl.[2] ..... F24H 3/06

[52] U.S. Cl. ..... 126/110 B

[58] Field of Search ..... 126/110 B; 165/169

[56] References Cited

U.S. PATENT DOCUMENTS

| | | | |
|---|---|---|---|
| 3,267,928 | 8/1966 | Spooner | 126/110 B |
| 3,267,929 | 8/1966 | Damon | 126/110 B |
| 3,822,690 | 7/1974 | Kofink | 126/110 B |
| 3,916,870 | 11/1975 | Beavers | 126/110 B |
| 4,034,734 | 7/1977 | Birney | 126/110 B |

*Primary Examiner*—William E. Wayner
*Assistant Examiner*—William E. Tapolcai, Jr.
*Attorney, Agent, or Firm*—Edwin L. Spangler, Jr.

[57] ABSTRACT

This invention relates to a skid-mounted portable heater blower unit for use on the surface to supply high temperature hot air to subsurface installations for the purpose of shrinking heat shrinkable sleeves around splices or other repairs made in underground cable, such heater being characterized by a serially-ducted preheater which draws ambient air in from the outside and warms it by passing it through the ducts back and forth four times in heat exchange relation to the hot products of combustion exiting the unit along the outside of an internal combination combustion chamber and final stage heat exchanger. The preheated air from the final pass through the preheater enters the secondary stage heat exchanger and follows a helical path around the outside of the combustion chamber while flowing in concurrent relation to the flame inside thereof and countercurrently to the products of combustion exiting around the outside. The air thus heated is preferably given one last charge of heat by passing it in heat exchange relation to the hot gaseous products of combustion just as they leave the combustion chamber and begin their migration along the outside of the secondary stage heat exchanger.

12 Claims, 6 Drawing Figures

FORCED AIR HEATER BLOWER

Underground cables must be maintained completely sealed against both air and moisture. In fact, they are slightly pressurized at all times from within. This leak tight integrity is most difficult to re-establish once a rupture has occurred or, more often, following the intentional opening of the cable covering to effect some repair or other necessary service.

For some time now, several manufacturers have offered a heat shrinkable plastic sleeve split longitudinally and provided with integrally-formed upstanding ribs bordering the slit on both sides that received a channel-shaped metal closure. These heat shrinkable sleeves have many applications, most of which entail applying the flame from a torch directly against the outside surface and sweeping it back and forth until the desired shrink around the workpiece has been effected.

In the repair of underground cable splices, this technique cannot by used because no open flames can be used underground due to the ever present danger of a combustible atmosphere. Accordingly, flameless heat is an absolute necessity if this type of heat shrinkable sleeve is to find application in subsurface installations, at least those housing utilities of one type or another.

The prior art attempts at using these sleeves underground have had a noteworthy lack of success, primarily due to the deficiencies in the surface heaters required to generate the necessary subsurface temperatures. The sleeves require a minimum of about 350° F. to initiate the shrinking process with at least 500° F. being preferred. In fact, at 600° F. the shrink process is greatly accelerated.

On the other hand, too high a temperature is equally bad if not, in fact, more serious because the insulation covering the conductors in the cable melts easily and fuses together causing short circuits and other expensive repairs. Along this same line, "hot spots" must also be avoided for the same reasons and carefully controlled downhole temperatures are, therefore, an absolute necessity.

Applicants are aware of at least one attempt to develop a heater blower for use in the manner described above; however, it proved to be unsuitable for the purpose. To begin with, the maximum temperature rise the prior art user was able to realize was 500° F. and this was only achieved at the expense of three times the BTU input of the instant heater blower. In fact, the prior art heater got so hot it melted its way into the pavement on which it rested.

It has now been found in accordance with the teaching of the instant invention that these and other shortcomings of the prior art surface mounted subsurface shrinkable sleeve heaters can in large measure be overcome by the simple, yet unobvious, expedient of preheating the fresh ambient air by repeatedly passing it back and forth in heat exchange relation to the hot products of combustion exiting the unit and then circulating the air thus preheated through a helical chamber heated on the inside by the burner flame and on the outside by the selfsame products of combustion used for preheating it. The resultant heater blower is capable of producing a temperature rise at its outlet of 800° F. which is more than enough to heat the sleeve to 600° F. and keep it there, all at a BTU input amounting to only about one-third of that required by the prior art heater developed for the same purpose to produce a temperature rise of only 500° F. Moreover, the resulting unit is still portable and easily handled in the field by two workmen. All in all, the air travels about 35 feet within a heater which, exclusive of its skid frame, is only 20 inches long, 10 inches wide and 12 inches high. The heater is not only thermostatically controlled but it includes a timer as well which functions to terminate the curing of the heat shrinkable sleeve following the elapse of a preselected time interval chosen by the operator.

Accordingly, it is, therefore, the principal object of the present invention to provide a novel and improved heater blower of a type especially suited for use in curing heat shrinkable sleeves on underground cables.

A second objective is the provision of a piece of apparatus of the type aforementioned which has an extremely high heat conversion efficiency for its size.

Another object of the invention herein disclosed and claimed is to provide a heater blower having a multistage heater exchanger, the preheating stage comprising a serially-ducted preheater almost completely enclosing the combination combustion chamber, a secondary heating stage comprising a helical passage circulating the preheated air between the combustion chamber and the hot gaseous products of combustion leaving the latter, and a final stage where the hot air leaving the second stage is passed in heat exchange relation to the hot gasses as soon as they exit the combustion chamber.

Still another objective of the within described invention is to produce a forced air heater having a time and temperature controlled heating cycle that, when properly used, essentially eliminates any chance of overheating or hot spotting.

An additional object is to provide a portable forced air furnace for use in combination with a flexible insulated duct and a fabric jacket to shrink and cure heat shrinkable sleeves housed inside the latter.

Further objects are to provide a heater blower apparatus which is compact, safe, reliable, easy to use, versatile, efficient, simple, relatively inexpensive and even decorative in appearance.

Other objects will be in part apparent and in part pointed out specifically hereinafter in connection with the description of the drawings that follows, and in which.

Figure 1:
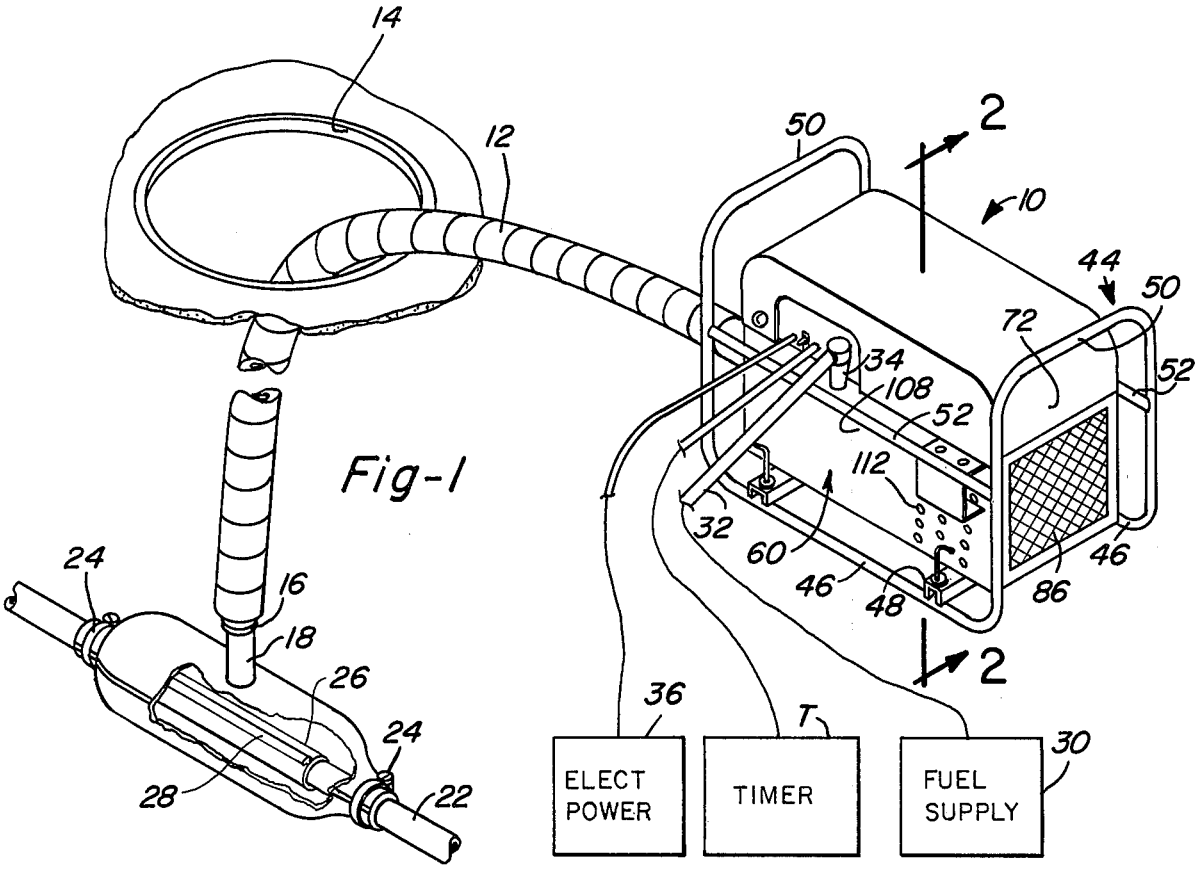
FIG. 1 is a perspective view, portions of which have been broken away and shown in section while others have been shown schematically, revealing the forced air heater in use in combination with an insulated flexible duct and a fabric sleeve to shrink and cure a heat shrinkable plastic sleeve onto an underground cable.

Referring next to the drawings for a detailed description of the present invention and, initially, to FIG. 1 for this purpose, reference numeral 10 has been chosen to broadly designate the forced air heater of the present invention while numeral 12 refers to the flexible insulated conduit or duct that receives the hot air therefrom and conducts it underground through an open manhole 14. The outlet 16 of the conduit detachably connects onto the centrally-located inlet 18 of inflatable jacket 20 which encases the spliced section (unnumbered) of cable 22. The opposite ends of the jacket 20 are held closed by clamps 24 to localize the heated air inside. The jacket is either vented (not shown) or formed from a porous fabric through which air can escape in the manner of a vacuum cleaner bag. An example of the type of jacket that can be used for this purpose will be found described in U.S. Pat. No. 3,368,289 entitled Air Dryer Jacket for Underground Electrical Cables. Encasing the splice or other cable repair is a heat shrinkable sleeve 26 which is slit longitudinally and fastened around the damaged area with a slide closure 28, both of which are commercially available items and, as such, form no part of the present invention.

In the particular form shown a supply of fuel 30, usually liquified propane or butane, is introduced into the unit through a hose 32 and conventional fuel filter 34. Electric power (36) is also supplied to the unit and is used to power an electric igniter 38 and flame sensor 40 (FIG. 2) along with a timer T and other electrically operated components associated with the latter such as, for example, a magnetically operated valve 42 (FIG. 3) which controls the supply of fuel to the burner thus providing the operator with time control over the heat shrink cycle to insure that no overheating occurs.

Next, with particular reference to FIGS. 1–4, inclusive, of the drawing, it will be seen that the unit includes a tubular skid frame which has been indicated in a general way by reference numeral 44 and which has a horizontally-disposed pair of parallel runners 46 that are interconnected by transverse supports 48 atop which the functional elements of the heater are mounted. Both ends of the runners are turned up and joined together as indicated at 50 to define carrying handles at opposite ends thereof. In the particular form shown, siderails 52 are provided interconnecting the inverted U-shaped handle-forming portions 50 at the ends. By making the skid frame 44 substantially larger than the functional elements of the unit supported thereon, the frame serves the additional function of a guardrail effective to prevent contact with the hot exterior surfaces adjacent the areas carrying the hot gaseous products of combustion.

Figure 2:
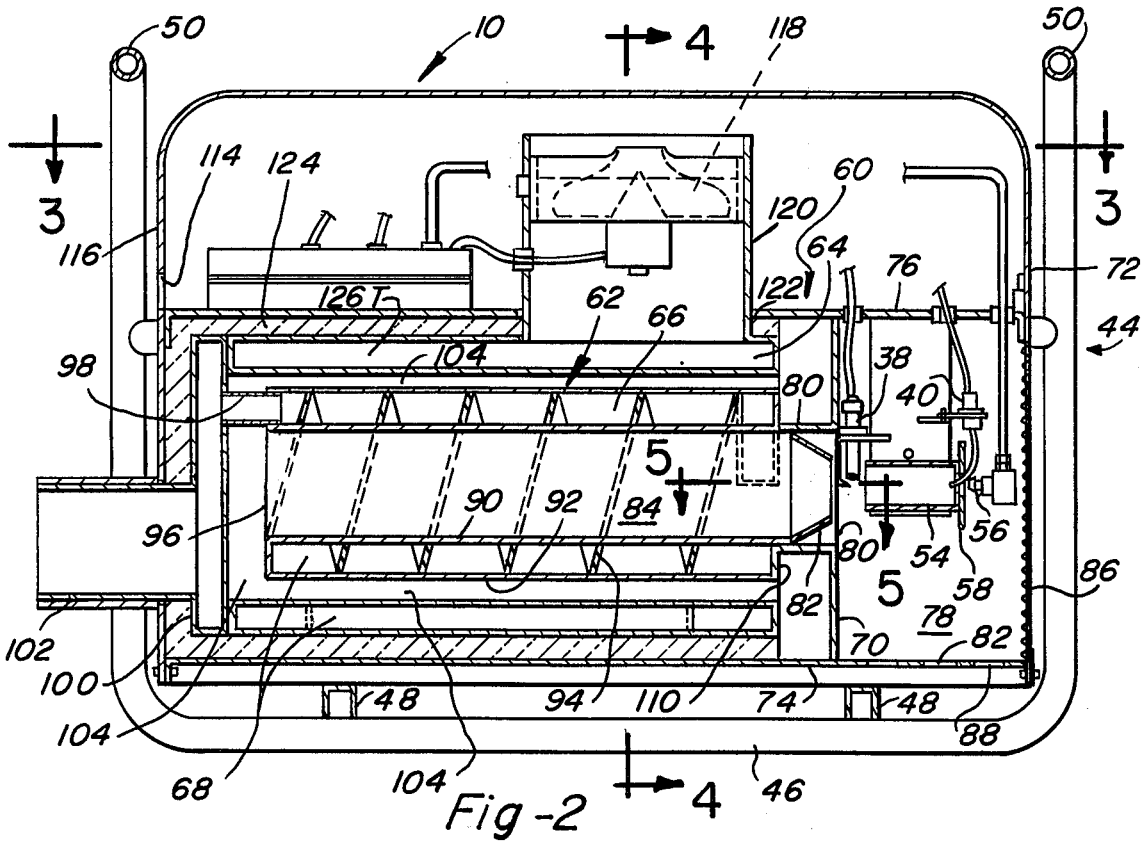
FIG. 2 is a longitudinal section taken to a larger scale along line 2—2 of FIG. 1.
Figure 3:
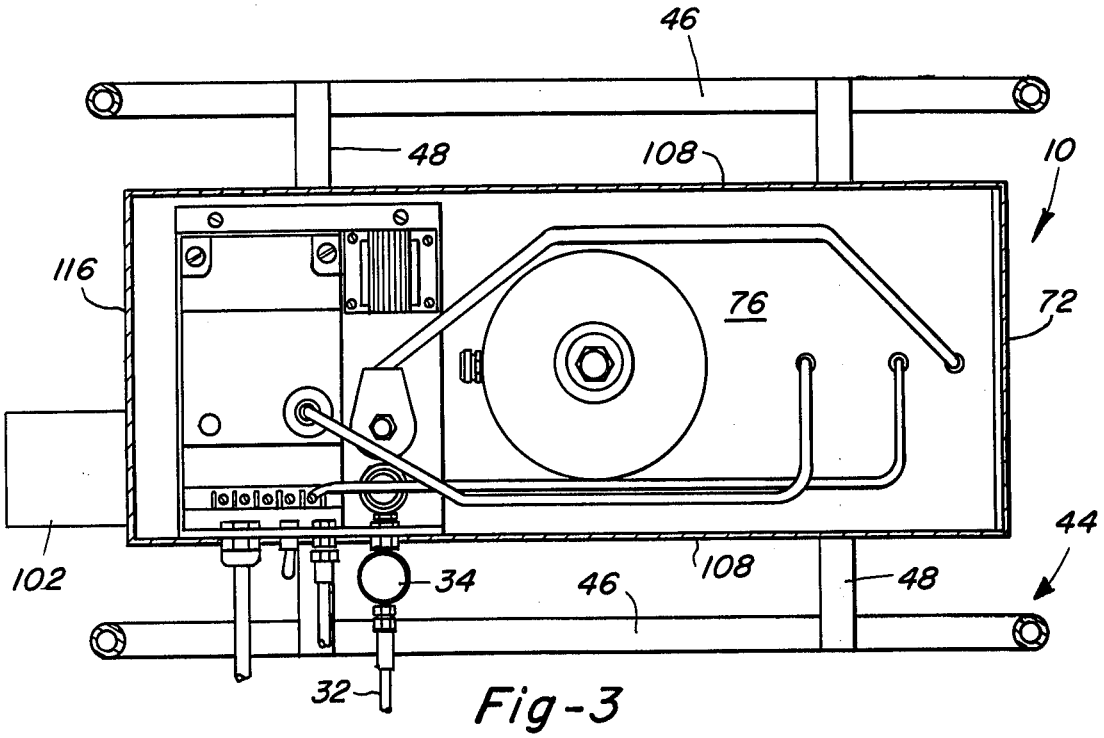
FIG. 3 is a horizontal section taken along line 3—3 of FIG. 2 to the same scale as the latter.
Figure 4:
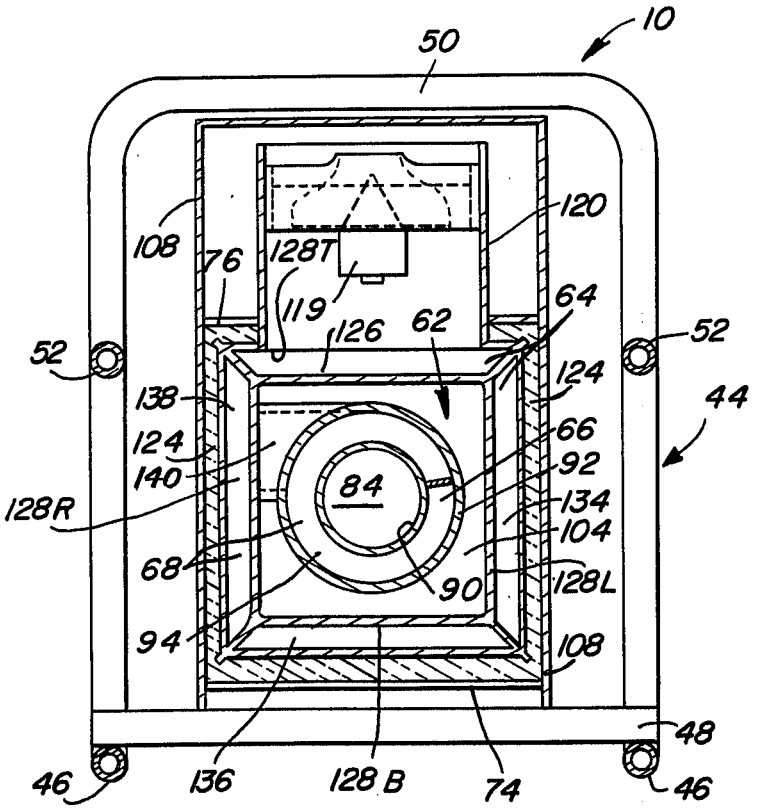
FIG. 4 is a vertical section taken along line 4—4 of FIG. 2, again to the same scale as the latter.

With reference next to FIG. 2, it will be seen that the fuel is piped into the burner 54 through a metering orifice 56 from the supply 30 thereof. An apertured air adjustment plate 58 is preferably interposed between the orifice 56 and the burner intake to control the fuel-air mixture. At the outlet end of the burner is positioned the electric igniter 38 which functions upon energization in the presence of a combustible mixture to ignite same in the well-known manner.

Also shown is flame sensor 40 located at the burner entrance. This sensor is operatively connected in the well-known manner to the fuel supply control valve 42 (FIG. 3) so as to shut off the supply of fuel automatically whenever the flame goes out.

An insulated housing indicated in a general way by reference numeral 60 is supported upon the crossframe elements 48 of the skid frame and, in turn, supports and houses the burner controls just described along with subassembly 62. Also contained within the housing are the preheater and secondary heat exchangers that have been referred to by reference numerals 64 and 66, respectively, and which combine to produce two of the stages of multistage heat exchanger 68.

Figure 5:
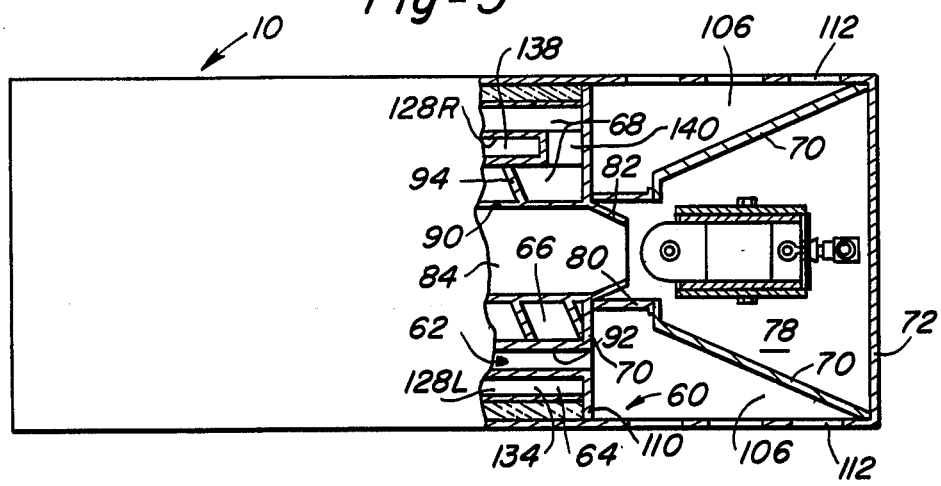
FIG. 5 is a top plan view, portions of which have been broken away along line 5—5 of FIG. 2 and shown in section, revealing the internal construction of the two stage heat exchanger, all to the same scale as FIGS. 2, 3 and 4; and, FIG. 6 is an exploded perspective view of the two stage heat exchanger and combustion chamber to a scale approximately the same as that of FIG. 1.
Figure 6:
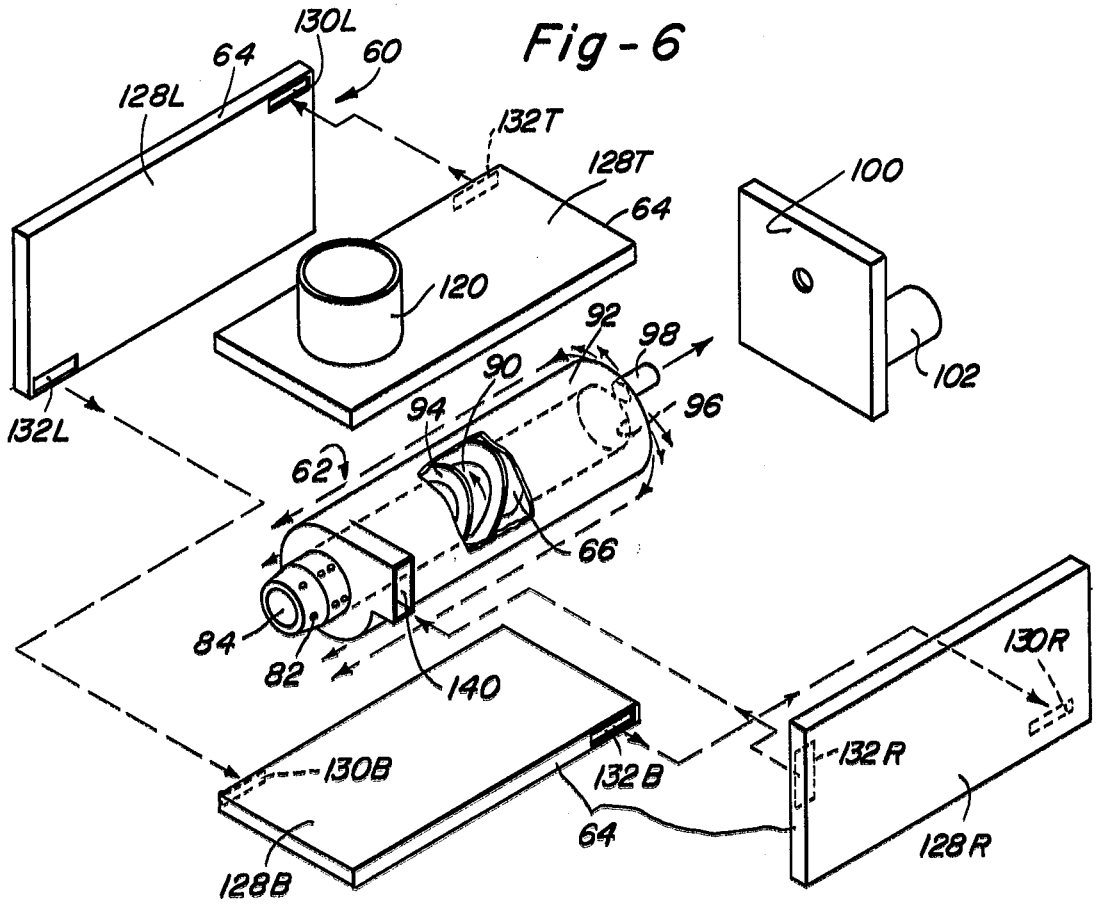

As shown most clearly in FIGS. 2 and 5 to which detailed reference will now be made, an apertured bulkhead 70 located inside the housing cooperates with one of its end walls 72, bottom wall 74 and horizontal partition wall 76 to produce a compartment 78 in which the aforesaid burner components are located. A collar 80 bordering the aperture in this bulkhead encircles the tapered intake 82 leading into the combustion chamber 84 which, in the particular form shown, is tubular and extends horizontally about two-thirds the length of the housing as seen most clearly in FIG. 2.

The front wall 72 includes a screen 86 while the bottom wall 74 is apertured at 88 within the burner chamber 78 to provide for the intake of combustion air. The fuel-air mixture is, of course, ignited within the burner and the resulting flame extends well out into the combustion chamber 84 under the pressure of the incoming fuel expanding through orifice 56.

FIGS. 2, 4, 5 and 6 most clearly reveal subassembly 62 which includes the combustion chamber and second stage heat exchanger 62 which will now be described in detail. This subassembly comprises a double-walled cylinder between the inside and outside walls 90 and 92 of which is provided the helical convolutions of a vane 94. The flame enters the combustion chamber 84 through tapered throat 82 while the hot products of combustion exit through opening 96 in the opposite end thereof in heat exchange relation to the hot air leaving the unit through tube 98 connected to receive the output from the convolutions of the second stage heat exchanger 66. This very hot air moves from tube 98 into the hollow interior of final stage heat exchanger 100 where it receives the last increment of heat from the hot products of combustion impinging thereagainst. This very hot air which has been heated to a temperature well in excess of 600° F. during its lengthy excursion across, alongside, underneath and around the combustion chamber, finally exits the unit into the intake of conduit 12 through outlet 102. Instead of these hot gases being exhausted to the atmosphere immediately, they are first recirculated back along the outside of subassembly 62 within annular space 104 in heat exchange relation with both the preheated air spiralling through the convolutions of second stage heat exchanger 66 and the cold fresh air being preheated within the serially-connected ducts of preheater 64. Once these products of combustion have flowed back toward the front of the unit in countercurrent flow relation to the incoming flame, they exit into exhaust cavities 106 defined by the horizontal partition wall 76, bottom wall 74, side walls 108, bulkhead 70 and the front end wall 110 of the combination heat exchanger and combustion chamber 62. The side walls 108 are provided with apertures 112 to let these exhaust gases escape into the atmosphere. Thus, the products of combustion are exhausted to the atmosphere above ground where they cannot contaminate the underground workings. In fact, the products of combustion are exhausted at the end of the unit remote from the manhole as shown in FIG. 1 where they have the best chance of being dispersed before they can enter the latter.

Next, detailed attention will be given to the flow of clean air taken from the atmosphere and heated to the temperature where it will accomplish the necessary shrinkage of sleeve 26 around the splice or other repair in cable 22 for which purpose continued reference will be had to FIGS. 2, 4, 5 and 6 where the multistage heat exchanger 68 and various ancillary components associated therewith are most clearly revealed. Fresh air from the atmosphere is sucked into the housing through ports 114 in rear end wall 116 by electric fan 118 mounted within the throat of air intake collar 120. Fan 118 is capable of developing a significant static pressure above ambient pressure within the heat exchanger 68 which is carrying the fresh air to be heated and delivered underground. A fan or blower capable of producing a static pressure of around 50 inches of water has proven entirely adequate.

Collar 120 extends down through an opening 122 in horizontal partition wall 76 where it connects into and delivers fresh air to the top of upper preheater duct 126. Duct 126 of the preheater along with the other three serially-connected ducts thereof which will be described presently are produced by generally-rectangular hollow sheet metal shell 128 closed both top and bottom as well as on all sides except for an intake port 130 and an exhaust port 132, usually positioned diagonally opposite one another. As illustrated, shell 128T containing duct 126 of preheater 64 rests in vertically-spaced relation atop the second stage heat exchanger portion of subassembly 62 as is most clearly shown in the exploded view of FIG. 6. Between it and the underside of partition wall 76 is glass wool or other insulation 124. Between shell 128T and the top of subassembly 62 lies the exhaust passage 104 through which the hot products of combustion flow forward toward the front end of the unit preparatory to being exhausted to the atmosphere as previously described.

Air taken into upper shell 128T exits the latter through exhaust port 132T located at one of the rear outside corners thereof. This port 132T registers with intake port 130L of left shell 128L as the latter would be viewed from the front of the unit facing rearwardly. Shell 128L is disposed vertically and defines the second serially-connected duct 134 of the series. Once again, shell 128L is separated from the adjacent side wall 108 of the housing by insulation 124. The intake port 130L is in the upper rear corner of the shell while the exhaust port 132L lies in its lower front corner where it connects into intake port 130B of bottom shell 128B as shown. Bottom shell 128B houses the third of the four serially-connected ducts 136 which carries the partially heated air rearwardly again along the bottom of the combustion chamber where it exits through exhaust port 132B in the rear right hand corner thereof that connects into intake port 130R of the right hand shell 128R. After passing upwardly and forwardly through the fourth and final serially-connected duct 138 of the preheater, the preheated air exits through exhaust port 132R and immediately enters the convolutions of second stage heat exchanger 66 through intake port 140 thereof. Thus, the cold fresh air has moved rearwardly across the top of the combustion chamber in countercurrent flow heat exchange relation with the hot gaseous products of combustion flowing around the outside of the second stage heat exchanger, then down and forwardly along the left side, from left to right rearwardly along the bottom, and upwardly and forwardly again along the right side to the point where it enters the second stage heat exchanger. The air thus prewarmed will have already stripped a good deal of the heat from the hot products of combustion flowing around the outside of the second stage heat exchanger. Inside the latter, preheated air will be spiralling along between the very hot surface of the combustion chamber directly heated by the flame from the burner and the outside surface of the second stage heat exchanger heated quite hot by the products of combustion. One last increment of heat is introduced into the hot air issuing from the second stage heat exchanger convolutions within final stage heat exchanger 100 which, as previously noted, receives the hot gaseous products of combustion at their hottest when they leave the end of the combustion chamber and before they enter the exhaust passage outside the second stage. As such, the hottest air is being heated by the hottest gases thus providing the maximum $\Delta t$ for fast efficient heat transfer. Note also that the cool gaseous products of combustion stripped of their heat enter the exhaust cavity 106 just after passing in heat exchange relation to the prewarmed gases leaving the preheater and entering the second stage heat exchanger where a $\Delta t$ still exists but not so great a one as to result in inefficient heat transfer. All in all, by the time the air leaves the final stage 100 of multistage exchanger 68, it will have traveled between 30 and 40 feet, all in direct heat exchange relation with either the hot gaseous products of combustion or the combustion chamber itself. The net result is hot air at a temperature well above 600° F. entering the underground installation at a rate in excess of 75 cubic feet per minute. In actual operation, hot air at a little over 500° F. has proven entirely adequate to heat shrink the sleeve; however, the additional capability is available if needed. Moreover, the unit supplying this heat remains small, portable and relatively cool in comparison to the prior art unit designed for this purpose.

What is claimed is:

1. A heater blower comprising: a hollow box-like housing having a first partition wall dividing the interior thereof into two separate compartments, air intake means communicating the interior of the first of said two compartments for introducing fresh air therein, a second partition wall dividing the interior of the second of said two compartments into a third and fourth compartment, fan means mounted within an opening in that portion of the first partition wall separating the first and third compartments for bringing fresh air into the latter, a third partition wall dividing the fourth compartment into a combustion air intake chamber and an exhaust chamber, openings in the housing communicating the interiors of both the combustion air intake and exhaust chambers, a combustion chamber located within the third compartment opening into the fourth compartment through the second partition wall, means comprising a burner connectable to a source of fuel located within the fourth compartment in position to direct a flame into the interior of the combustion chamber, a jacket encasing the combustion chamber in heat exchange relation therearound cooperating therewith to define a heat exchanger having an inlet and an outlet sealed against the products of combustion, a serially-connected series of ducts encasing the jacketed combustion chamber so as to define an exhaust passage therebetween having an inlet connected to receive the hot gaseous products of combustion from the combustion chamber and an outlet connected to deliver same to the exhaust chamber, said ducts having an inlet connected to receive fresh air from the fan means and an outlet connected to deliver same to the inlet of the heat exchanger, the portions of said ducts between the inlet and outlet defining a circuitous passage alongside said exhaust passage effective to preheat the fresh air preparatory to delivering same to the heat exchanger, and the interior of said heat exchanger being partitioned to define an extension of said circuitous passage alongside said exhaust passage effective to take the preheated air and further heat same in advance of discharging it from the heat exchanger outlet.

2. The heater blower as set forth in claim 1 which includes means connected to the outlet of the heat exchanger adapted to receive the hot air therefrom and pass it in heat exchange relation to the products of combustion passing between the combustion chamber and exhaust passage.

3. The heater blower as set forth in claim 1 wherein the serially-connected ducts comprise the double walls of a box-like enclosure located within the third compartment in spaced relation outside the jacketed combustion chamber contained therein.

4. The heater blower as set forth in claim 2 wherein the means connected to receive the hot air from the heat exchanger comprises a hollow end wall located within the third compartment at the end of the combustion chamber opposite that in which the flame enters.

5. The heater blower as set forth in claim 1 wherein the serially-connected ducts comprise the four walls of a four walled enclosure, each wall containing an inlet and an outlet so located that the fresh air passing therebetween must travel essentially the full length of the exhaust passage.

6. The heater blower as set forth in claim 1 wherein the circuitous passage is so arranged that the fresh air passing between the inlet and outlet thereof must travel back and forth along the exhaust passage four times.

7. The heater blower as set forth in claim 1 wherein the partitioning inside the heat exchanger comprises a helicoidal vane effective to direct the preheated air in a spiral path therealong.

8. The heater blower as set forth in claim 1 wherein the air flow within the heat exchanger is essentially concurrent with respect to the hot gaseous products of combustion within the combustion chamber and essentially countercurrent with respect to the latter as they travel along the exhaust passage.

9. The heater blower as set forth in claim 1 wherein the hot gaseous products of combustion are discharged from the exhaust chamber at a point remote from the air intake means.

10. The heater blower as set forth in claim 1 wherein the hot gaseous products of combustion are discharged from the exhaust chamber at a point remote from the outlet of the heat exchanger.

11. The heater blower as set forth in claim 1 wherein the third compartment is insulated and all elements inside said compartment are surrounded on all sides by said insulation.

12. The heater blower as set forth in claim 5 wherein the inlet and outlet in at least three of the four ducts are located adjacent opposite corners thereof.

* * * * *